US007062062B2

(12) United States Patent
Kuwabara

(10) Patent No.: US 7,062,062 B2
(45) Date of Patent: Jun. 13, 2006

(54) ELECTROMAGNETIC SOUND PRODUCING DEVICE

(75) Inventor: Atsushi Kuwabara, Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 10/090,818

(22) Filed: Mar. 6, 2002

(65) Prior Publication Data

US 2002/0126868 A1 Sep. 12, 2002

(30) Foreign Application Priority Data

Mar. 12, 2001 (JP) ..... 2001-069513

(51) Int. Cl.
*H04R 25/00* (2006.01)

(52) U.S. Cl. ..... 381/412; 381/417; 381/396; 381/398

(58) Field of Classification Search ..... 381/412, 381/413, 414, 415, 396, 398, 409, 410, 417
See application file for complete search history.

(56) References Cited

U.S. PATENT DOCUMENTS

| | | | | |
|---|---|---|---|---|
| 5,625,700 | A * | 4/1997 | Sone | 381/396 |
| 6,654,478 | B1 * | 11/2003 | Tsuchikiri et al. | 381/412 |
| 2002/0197512 | A1 * | 12/2002 | Aizawa et al. | 428/693 |

FOREIGN PATENT DOCUMENTS

| | | |
|---|---|---|
| JP | 2000202036 | 7/2000 |
| KR | 0005750 | 4/1997 |
| KR | 12495 | 3/2000 |

* cited by examiner

*Primary Examiner*—Curtis A. Kuntz
*Assistant Examiner*—Tuan Duc Nguyen
(74) *Attorney, Agent, or Firm*—Dennison, Schultz, Dougherty & MacDonald

(57) ABSTRACT

An electromagnetic sound producing device has a yoke, a coil, a permanent magnet, and a diaphragm provided in a case. The permanent magnet is made of SmFeN-base isotropy plastic magnetic material.

3 Claims, 5 Drawing Sheets

ELECTROMAGNETIC SOUND PRODUCING DEVICE

BACKGROUND OF THE INVENTION

The present invention relates to a sound producing device operated by an electromagnet.

A conventional small electromagnetic sound producing device having a permanent magnet has a disadvantage such that the device can not be made into a thin thickness, since the magnetic force of the permanent magnet reduces to reduce the produced sound.

SUMMARY OF THE INVENTION

An object of the present invention is to provide an electromagnetic sound producing device which may be reduced in thickness without reducing the produced sound.

According to the present invention, there is provided an electromagnetic sound producing device comprising a case, a yoke, a coil, a permanent magnet, and a diaphragm provided in the case, the permanent magnet being made of SmFeN-base isotropy plastic magnetic material.

The permanent magnet has a cylindrical shape.

The yoke has a center pole and is mounted on a base of the case, the coil has a cylindrical shape and is mounted on the yoke, surrounding the center pole.

The diaphragm is mounted on the cylindrical permanent magnet.

These and other objects and features of the present invention will become more apparent from the following detailed description with reference to the accompanying drawings.

DETAILED DESCRIPTION OF THE PREFERRED EMBODIMENT

Figure 1:
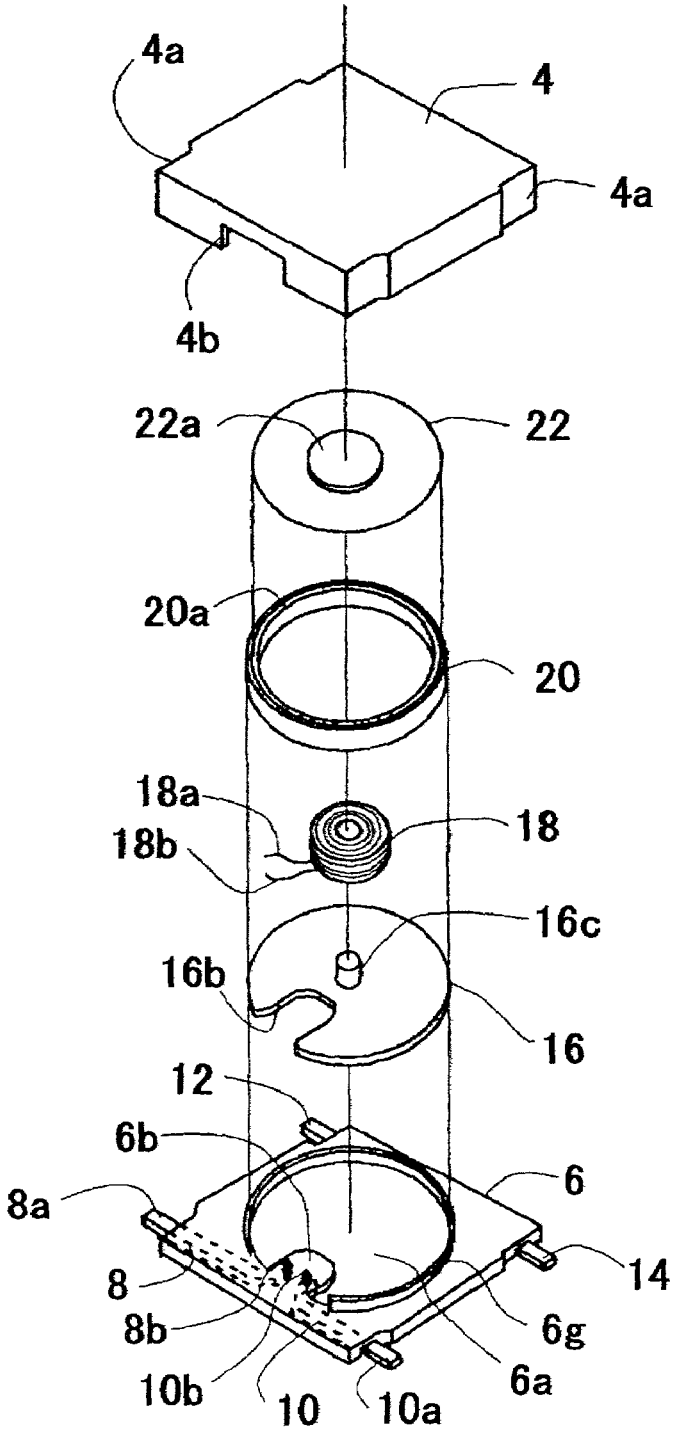
FIG. 1 is an exploded perspective view of an embodiment of an electromagnetic sound producing device of the present invention.

Referring to FIGS. 1 through 4, the electromagnetic sound producing device of the first embodiment of the present invention has a case 1 comprising an upper case 4, and lower case 6 which are made of plastic. In the case 1, a yoke 16, cylindrical coil 18, cylindrical permanent magnet 20 and diaphragm 22 are provided.

The lower case 6 has a circular recess 6*a* surrounded by an annular projection 6*g*. A projection 6*b* is projected from the periphery of the recess 6*a* in a radial direction.

Four terminals 8, 10, 12 and 14 are embedded in the lower case at four corners by the insert molding. Outer end portions 8*a* and 10*a* of the terminals 8 and 10 are projected from the lower case 6. Inner end portions of the terminals 8 and 10 are projected from the projection 6*b* to form connecting portions 8*b* and 10*b*.

In the recess 6*a*, the yoke 16 is securely mounted. The yoke 16 has a center pole 16*c* and a recess 16*b* which engages with the projection 6*b* of the lower case 6. The yoke and the center pole 16*c* are made of magnetic material.

The cylindrical coil 18 is mounted on the yoke, surrounding the center pole 16*c*. Two lead wires 18*a* and 18*b* are drawn from the coil 18 and connected to the connecting portions 8*b* and 10*b* so that the coil 18 can be connected to an outside driving circuit through the terminals 8 and 10.

The cylindrical permanent magnet 20 is mounted on the yoke 16, surrounded by the annular projection 6*g* of the lower case 6. The permanent magnet 20 has an annular projection 20*a* at a peripheral portion of the top surface thereof. The diaphragm 22 having an armature 22*a* is mounted on the top surface of the permanent magnet 20 surrounded by the annular projection 20*a*.

Figure 2:
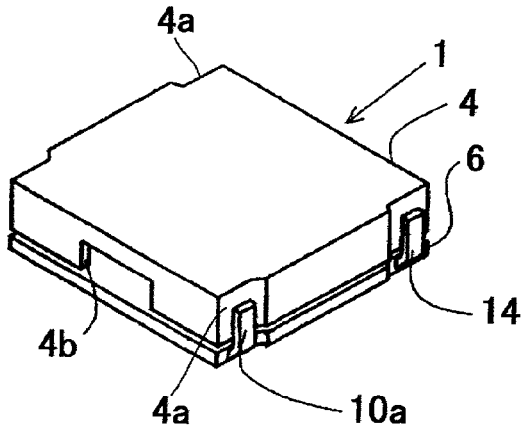
FIG. 2 is a perspective view of the device.
Figure 3:
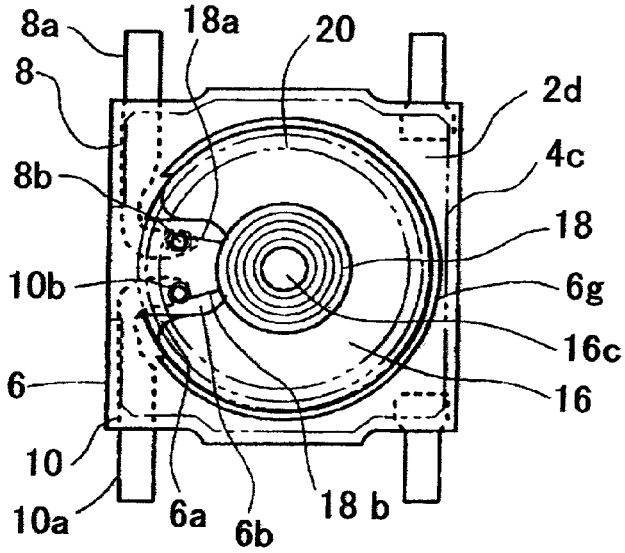
FIG. 3 is a plan view showing inner construction of the device.
Figure 4:
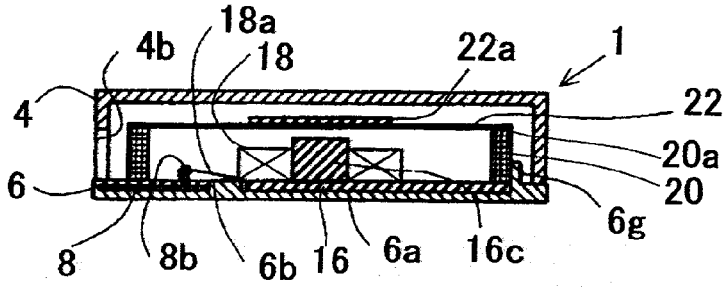
FIG. 4 is a sectional view of the device.

The upper case 4 has four recesses 4*a* at four corners and has a sound discharge opening 4*b*. As shown in FIG. 4, the upper case 4 is mounted on the lower case 6 and adhered thereto, and the four terminals 8, 10, and 14 are upwardly bent into the recess 4*a* as shown in FIG. 2. Thus, the sound producing device is assembled.

The permanent magnet 20 is made of SmFeN-base isotropy plastic material. The plastic plate for preparing the permanent magnet 20 can be molded by the injection molding because the plastic is isotropic. After the molding of the plastic plate, the plastic plate is magnetized in a necessary direction.

In the sound producing device of the present invention, there is provided resonating rooms at four corners 2*d* and between the diaphragm 22 and the upper case 4. The sound pressure produced by the diaphragm 22 is increased in the resonating rooms, and discharged from the discharge opening 4*b*.

A magnetic circuit from the permanent magnet 20 is formed by passing through the yoke 16, the center pole 16*c* and the diaphragm 22. When a driving current is applied to the coil 18, the driving magnetic flux by the coil 18 is added to the bias magnetic flux in the magnetic circuit, thereby changing the magnetic attraction force for the diaphragm. Thus, the diaphragm 22 is vibrated to produce sounds.

Figure 5:
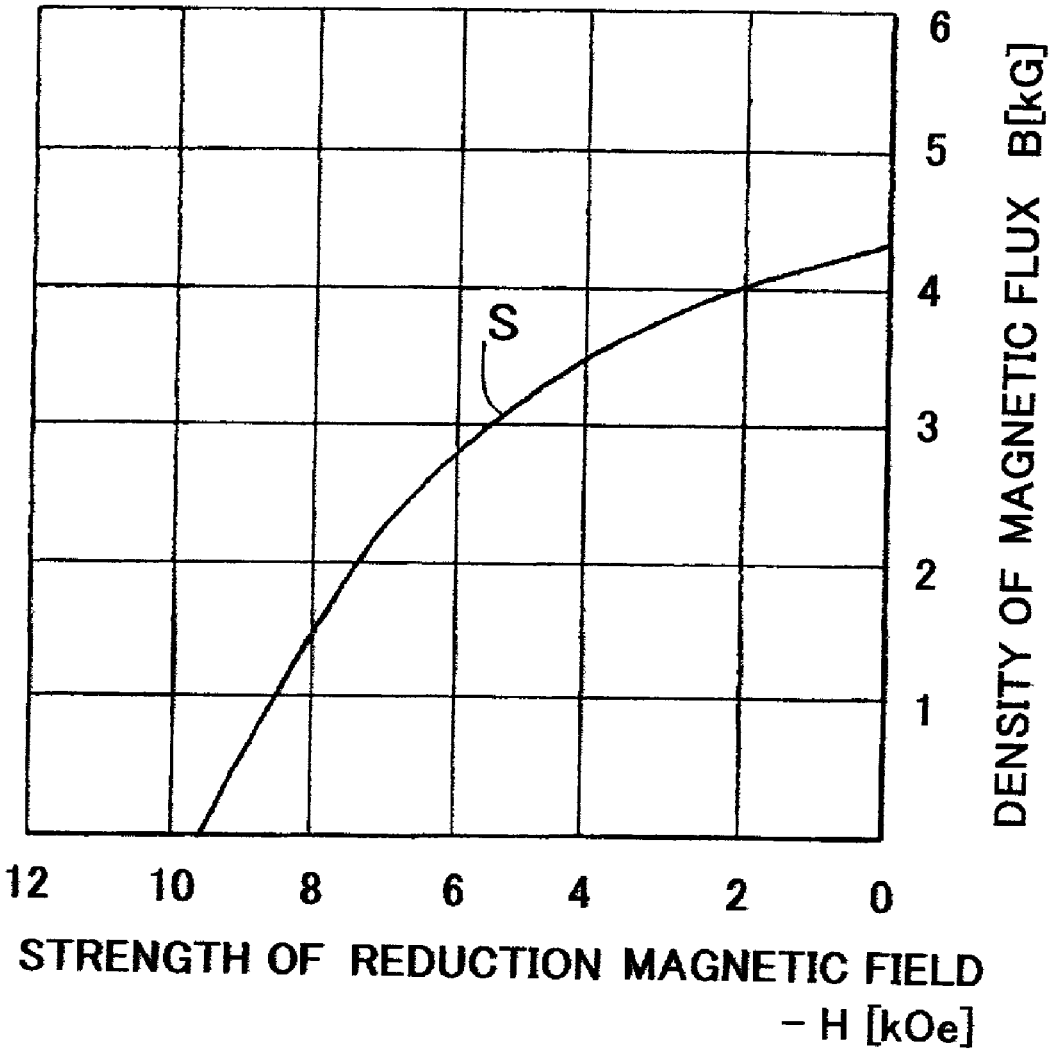
FIG. 5 is a graph showing a magnetic characteristic of a permanent magnet provided in the device.

FIG. 5 is a graph showing the magnetic characteristic of the permanent magnet 20 of SmFeN-base isotropy plastic. The abscissa represents the strength of a reduction magnetic field and the ordinate represents the density of the magnetic flux. The curve S represents magnetic characteristic at the temperature of 25° C. As shown in the graph, the density of the magnetic flux does not reduce, thereby holding a sufficient magnetic energy (BHmax=32.0 MGOe). Consequently, if the magnet 20 is made into a plate having a small size and thin thickness, the magnetic force of the permanent magnet 20 is not reduced by the magnetic circuit. Thus, it is possible to increase the sound strength discharged from the sound discharge opening 4*b* of the small sound producing device.

Figure 6:
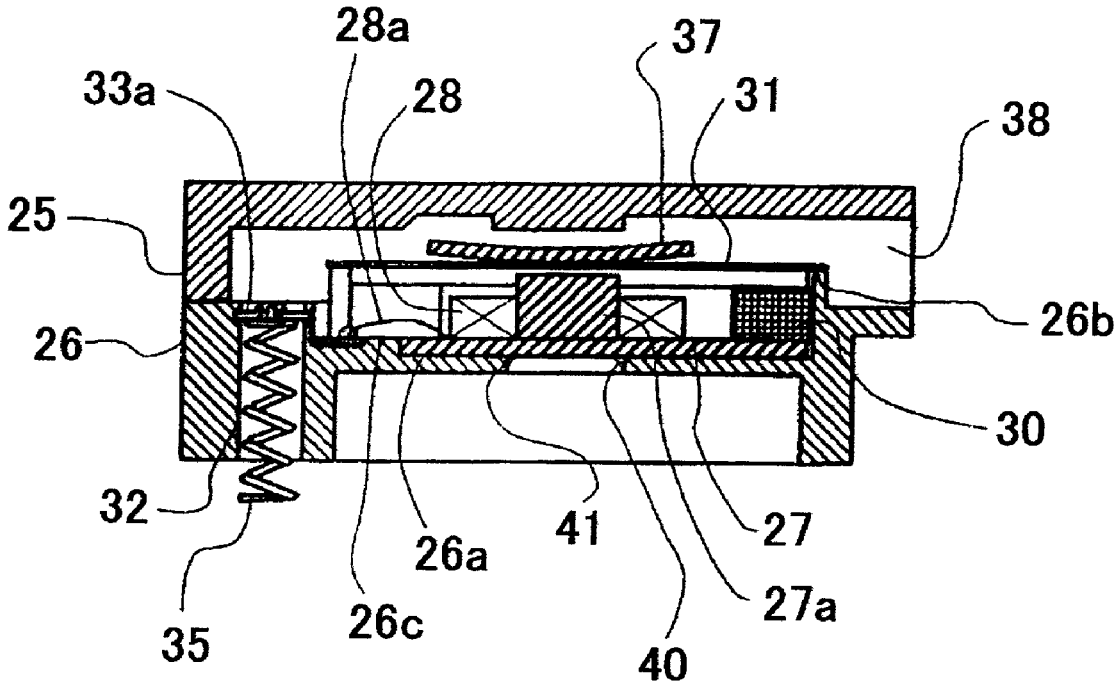
FIG. 6 is a sectional view of the device of a second embodiment of the present invention.
Figure 7A:
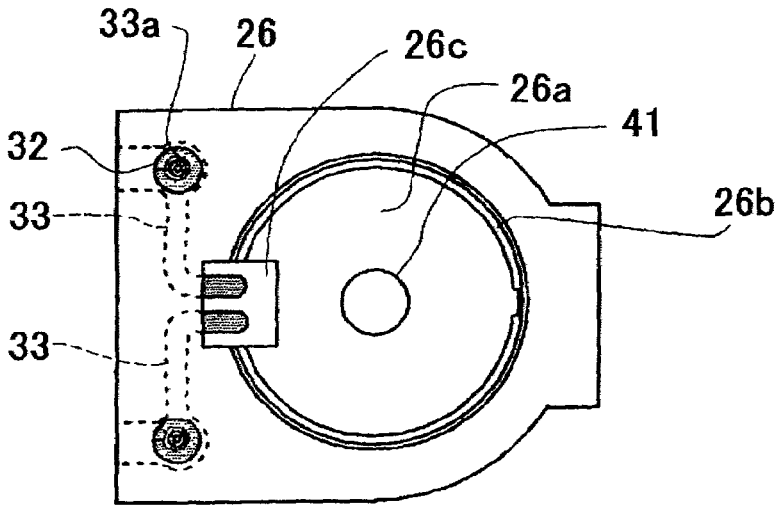
FIG. 7*a* to 7*c* are plan views showing inner construction of the second embodiment at different assembling steps.
Figure 7B:
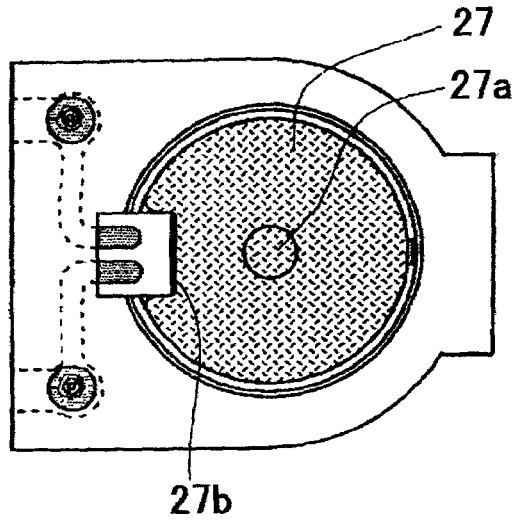
Figure 7C:
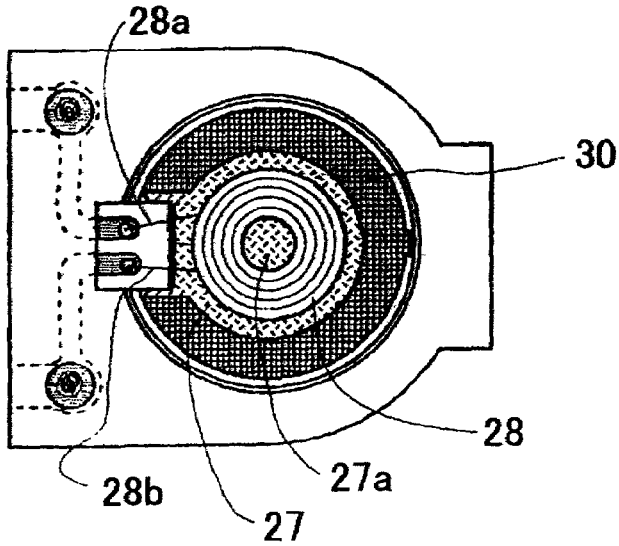

Referring to FIGS. 6 to 7*c* showing the second embodiment of the present invention, the device of the second embodiment comprises upper and lower cases 25 and 26, a yoke 27, cylindrical coil 28, cylindrical permanent magnet 30 and diaphragm 31.

The lower case 26 made of plastic has a circular recess 26*a* surrounded by an annular projection 26*b*. A projection 26*c* is projected from the periphery of the recess 26*a* in a radial direction.

A pair of terminal holes 32 are formed in the lower case 26 at an end portion, penetrating the lower case 26 from the upper surface to the underside. A pair of terminals 33 are embedded in the lower case 26 by the insert molding. One end of each of the terminals 33 is exposed from the upper surface of the lower case, and the other end is exposed in the terminal hole 32 as a terminal connecting portion 33*a*. In each hole 32, a spring terminal 35 is inserted, and the upper end thereof is soldered to the terminal connecting portion 33*a* of the terminal 33 in the hole 32.

In the recess 26*a*, the yoke 27 is securely mounted by an adhesive 40 provided in a hole 41 formed in the bottom of the recess 26*a*. The yoke 27 has a center pole 27*a* and a recess 27*b* which engages with the projection 26*c* of the lower case 26. The yoke and the center pole 27*a* are made of magnetic material.

The cylindrical coil 28 is mounted on the yoke, surrounding the center pole 27*a*. Two lead wires 28*a* and 28*b* are drawn from the coil 28 and soldered to the inner ends of the terminals 33 exposed from the upper surface of the lower case 26, so that the coil 28 can be connected to an outside driving circuit through the terminals 33.

The cylindrical permanent magnet 30 is made of SmFeN-base isotropy plastic magnetic material and mounted on the yoke 27, surrounded by the annular projection 26*b* of the lower case 6. The diaphragm 31 having an aramature 37 is mounted on the top surface of the projection 26*b* of the lower case 26.

The upper case 25 has a sound discharge opening 38. The upper case 25 is mounted on the lower case 26 and adhered thereto. Thus, the sound producing device is assembled.

In accordance with the present invention, the permanent magnet is made of SmFeN-base isotropy plastic magnetic material which holds a density of magnetic flux. Therefore, an electromagnetic sound producing device having a large sound strength in spite of a small size and a thin thickness can be provided.

While the invention has been described in conjunction with preferred specific embodiment thereof, it will be understood that this description is intended to illustrate and not limit the scope of the invention, which is defined by the following claims.

What is claimed is:

1. An electromagnetic sound producing device comprising:

a case comprising an upper case having a peripheral surrounding wall, and a lower case;

a recess formed in an upper surface of the lower case;

a yoke having a generally circular shape and being mounted on a bottom of the recess of the lower case;

a coil mounted on the yoke;

a permanent magnet made of SmFeN-base isotropy plastic magnetic material having a cylindrical shape and mounted on the yoke so as to surround the coil on the yoke;

a diaphragm secured to a top of the permanent magnet; and a pair of terminals embedded in the lower case, an outer end of each of the terminals being projected from the lower case, and an inner end of the terminals being exposed from the lower case at a position adjacent to the coil and connected to a corresponding end of the coil to form a resonating space between an outer side surface of the permanent magnet, an upper surface of the diaphragm and an inside wall of the upper case.

2. The device according to claim 1, wherein the yoke has a center pole and the coil has a cylindrical shape and is mounted on the yoke, surrounding the center pole.

3. The device according to claim 1 further comprising a sound discharging opening formed in the upper case at the peripheral surrounding wall.

* * * * *